United States Patent [19]

Woo

[11] Patent Number: 4,700,686

[45] Date of Patent: Oct. 20, 1987

[54] HEATING APPARATUS

[76] Inventor: Chi G. Woo, 2119 Potspring Rd., Lutherville, Md. 21093

[21] Appl. No.: 943,039

[22] Filed: Dec. 18, 1986

[51] Int. Cl.[4] ..... F24F 3/14

[52] U.S. Cl. ..... 126/113; 126/5; 126/53; 126/110 E; 126/116 A; 126/114; 122/14; 122/15

[58] Field of Search ..... 126/123, 374, 737, 305, 126/99 R, 110 E, 116 A, 114, 5, 53, 54, 34, 35, 31, 101; 122/14, 15

[56] References Cited

U.S. PATENT DOCUMENTS

| | | | |
|---|---|---|---|
| 2,533,508 | 12/1950 | Riu | 126/101 |
| 4,241,719 | 12/1980 | Vickery | 126/113 X |
| 4,409,955 | 10/1983 | Christian | 126/99 A X |
| 4,461,242 | 7/1984 | Black | 126/101 X |
| 4,479,481 | 10/1984 | Ingersoll et al. | 126/109 X |
| 4,516,534 | 5/1985 | Jahier | 126/361 X |

*Primary Examiner*—Larry Jones

*Attorney, Agent, or Firm*—Birch, Stewart, Kolasch & Birch

[57] ABSTRACT

A heating apparatus comprising a water container, a firebox for heating the water in the water container, a heating chamber containing a plurality heat emitting members disposed therein, a water storage tank disposed on the water container, and a fan for blowing hot air around the plurality of heat emitting member and circulating the heated air into the room whereby the heating apparatus produces hot air with a controlled humidity while at the same time reducing fire danger and pollution due to dust smoke and ash.

7 Claims, 3 Drawing Figures

HEATING APPARATUS

BACKGROUND OF THE INVENTION

The present invention relates to a heating apparatus for use indoors, especially for use in a fireplace of a house. More particularly, the present invention relates to a heating apparatus which comprises a water container, a fireplace compartment for heating the water disposed within the water container, and a plurality of heat emitting members including a blowing system for circulating hot air from the fireplace through the water and to the heat emitting elements for heating the house while reducing many problems associated with fire danger.

Many types of heating apparatus used indoors are well known in the art. Usually, a fireplace located in the wall of a house is used as a source of heat in cold weather. However, it is very difficult to recover the heat from the fireplace when burning materials such as wood or kerosene. Furthermore, there always exists danger of fire and the mess produced by dust and ash generated from the fireplace. Thus, there are many problems associated with prior art fireplaces or indoor heating apparatus.

OBJECTS AND SUMMARY OF THE INVENTION

Accordingly, it is an object of the present invention to provide an improved heating apparatus.

Another object of the present invention is to provide a heating apparatus, particularly one which can be positioned in a fireplace of a house.

A further object of the present invention is to provide a heating apparatus comprising a water storage tank, a fireplace chamber for heating the water, a plurality of heat emitting members and a fan for circulating the hot air emitted from the plurality of heat emitting members to the room.

Still another object of the present invention is to provide a heating apparatus which contains a water storage tank disposed on the water container for supplying water to the water container as well as maintaining the humidity of the environment.

A further object of the present invention is to provide a heating apparatus which is structured with a first floor fireplace provided with a burner for burning kerosene and a second floor fireplace for burning firewood so that the heating apparatus can be utilized with both types of fuel, i.e. liquid fuel or firewood or both.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to a heating apparatus which comprises a water container, a fire box for heating the water in the water container, a heating chamber containing a plurality heat emitting members disposed therein, a water storage tank disposed on the water container, and a fan for blowing hot air around the plurality of heat emitting member and circulating the heated air into the room, whereby the heating apparatus produces hot air with a controlled humidity while at the same time reducing fire danger and pollution due to dust smoke and ash.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
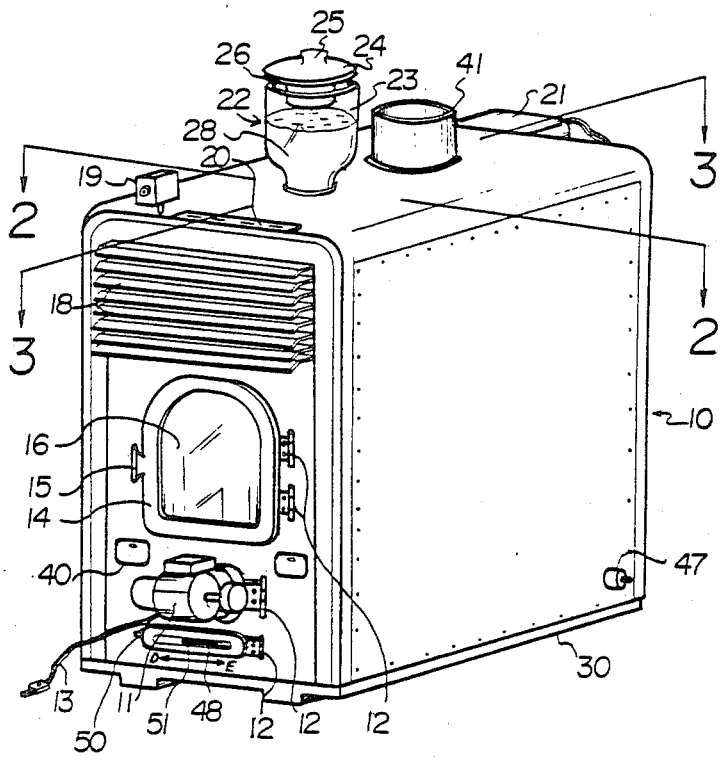
FIG. 1 is a perspective view of the heating apparatus of the present invention.
Figure 2:
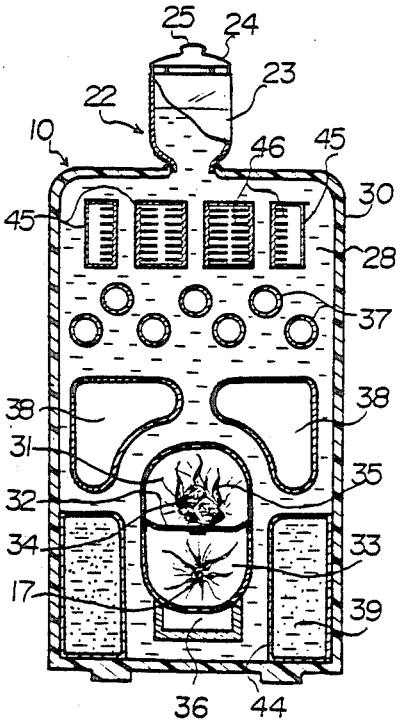
FIG. 2 is a cross-sectional view of FIG. 1, taken along line 2—2.
Figure 3:
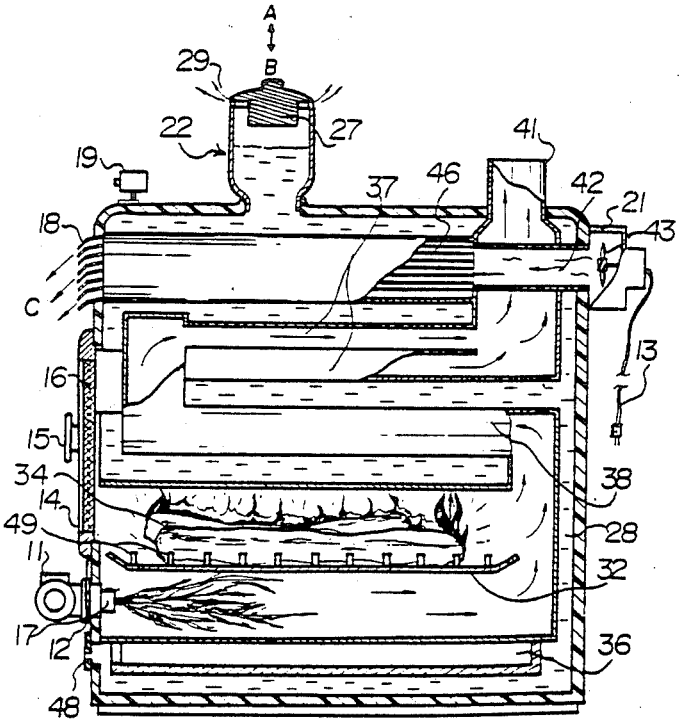
FIG. 3 is a cross-sectional view of FIG. 1, taken along line 3—3.

Referring now in detail to the drawings for the purpose of illustrating the present invention, a heating apparatus 10 as shown in FIG. 1, 2 and 3 comprises a water container 30, adapted to contain water 28, a burner 11 operatively associated with a fire box, disposed in the lower portion of the front side wall of the water container 30, a fireplace door 14 disposed at the middle portion of the front side wall of the water container 30, a water storage tank 22 extending from the top of the water container 30, a plurality of heating chamber 45 disposed in the upper area of the water container 30, and a chimney 41 disposed on the top of the water container 30.

The fire box disposed in the water container 30 includes a first floor 31 and a second floor 33 for burning either firewood or liquid fuel, respectively. The fire box is divided into the first and second floors 31 and 33 by a fireplace shelf 32. Also, the water container 30 includes liquid fuel storage tanks 44 disposed in the lower portion thereof, a plurality of upper and lower heat conduits 37 and 38 while communicate with the fire box for conveying heat from the fire box, and a fan 43 disposed at the upper rear side wall thereof (FIGS. 2 and 3).

The burner 11 mounted to the front side wall through a hinge 12 is provided with an electric wire 13 for igniting and the nozzle 17 is disposed in the second floor 33 of the fire box. The fire box door 14 which has a handle 15 is mounted to the front side wall through hinges 12 and includes a glass 16 having high temperature mechanical properties for viewing the heat conduits 38 (FIG. 1). The fire box shelf 32 contains a plurality of projecting members 49 holding the firewood 34. An air controlling member 48 is mounted to the lowest portion of the front side wall of the water container 30 through hinge 12, and includes a handle 50 and a gauge 51 for controlling the volume of fresh air to the fire boxes 31 and 33 by moving the gauge 51 in the direction indicated by arrow (D) and (E) as shown in FIG. 1. Also, the air controlling member 48 functions as door for cleaning out the ash 36 disposed below the fire boxes 31 and 33.

The lower heat conduits 38 disposed in the middle area of the water container 30 and the plurality of upper heat conduits 37 having a smaller diameter than that of the heat conduits 38 pass through the water container 30 and deliver the heat from the fire boxes 31 and 33 to the chimney 41, heating the water 28 in the water container 30 during the process. The lower heat conduits 38 communicate with the upper heat conduits 37 is a serpentine configuration. The plurality of heat chambers 45 containing a plurality of heat emitting members 46 are heated by the hot water circulating in the water container 30. The fan 43 inserted in a fan housing 21 blows air through chamber 42 in indirect heat exchange with the exhaust gas passing through conduits 38 and 37 into the plurality of heat chambers 45 and heat emitting members 46 for blowing hot air to the outside of the heating apparatus 10 through a plurality of louvers 18. The louvers 18 control the direction of the heat in any desired direction.

The water storage tank 22 comprises a bottle 23 which communicates with the water container 30 and a cap 24 having a handle 25, an extension member 27 (FIG. 3) and a plurality of raised portions for providing a space between the bottle 23 and the cap 24 to permit steam 29 to escape. Thus, the steam 29 from the water storage tank 22 can maintain the humidity in the room. When necessary, the water can be supplied through the top of storage tank 22. Also, since the open water storage tank 22 communicates with the water container 30, the water container 30 is prevented from exploding due to the accumulation of excess temperature or pressure in the container 30.

A controller 19 and a controlling panel 20 are disposed at the front portion in the top wall of the water container 30. The controller 19 controls the temperature in the water container 30 and actuates the fan 43 disposed in the fan housing 21 at a predetermined indoor temperature of the blowing chamber 45. Also, an on/off switch is disposed on the control panel 20 to actuate the burner 11 mounted to the front side wall of the heating apparatus 10.

The liquid fuel storage tanks 44 include feed inlets 40. Usually, the liquid fuel 39 is kerosene. The water container 30 is provided with a water draining member 47 for discharging the water in the container 30.

In the operation, after the water container 30 is filled with water as shown in FIG. 1 and pieces of firewood 34 are disposed on the plurality of the projecting member 49 of the fireplace shelf 32, the on/off switch disposed at the controlling panel 20 is actuated to ignite the nozzles 17 of the burner 11.

The burning firewood 34 heats the water in the water container 30, and the plurality of heat emitting members 46 disposed in the heat chambers 45 are heated by the heated water of the water container 30. At this time, the fan 43 disposed in the fan housing 21 is actuated to blow air through the blowing chamber 42. Accordingly, the hot air around the heat emitting members 46 is blown out in the direction indicated by an arrow (C) as shown in FIG. 3. The hot air is thus transferred to the room environment. The temperature in the indoors can be automatically controlled by the controller 19. By actuating the on/off switch disposed at the controlling panel 20, the burner can be continued or discontinued, as necessary, to burn the firewood 34. Also, the water inlet storage tank 22 is provided with a space so that it can prevent the heating apparatus 10 from exploding and add humidity to the room during the operation of the heating apparatus.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A heating apparatus comprising:

a water container, means for introducing water to said water container, said means for introducing water to said water container including a water bottle which is vented to the atmosphere to add humidity to the room environment and to provide a safety relief valve for excess temperature and pressure, a fire box disposed within said water container, said fire box being provided with a burner, a plurality of heating chambers disposed in the upper portion of said water container and communicating with the room environment, said heating chamber containing heat emitting members disposed therein for absorbing heat from the water disposed in the water container, air conduit means extending through said water container, said air conduit means connected at one end to the fire box and at the other end to the top of the container for circulating hot combustion gases therethrough and for heating the water disposed in the water container, said combustion gases being vented from said top of the container, and fans means communicating with said heating chambers for blowing air across said heat emitting members to heat said air and discharge it to the room environment.

2. The heating apparatus of claim 1 wherein the air from the fan means is in heat exchange relationship with the air conduit means carrying the exhaust gas.

3. The heating apparatus of claim 1 wherein the fire box is divided by a shelf into an upper chamber and a lower chamber, said lower chamber containing said burner means and said upper chamber adapted to contain a solid fuel.

4. The heating apparatus of claim 1 wherein fuel supply tanks are disposed in the lower portion of the water container.

5. The heating apparatus of claim 1 wherein the air conduit means have a serpentine configuration.

6. The heating apparatus of claim 1 wherein the water container is provided with a transparent door.

7. The heating apparatus of claim 1 wherein a door provided in air inlet vent to the firebox is disposed at the front of the water container for removing burnt ash dropped from the upper chamber through the shelf disposed in the firebox.

* * * * *